United States Patent [19]

Jones, Jr. et al.

[11] 4,042,485

[45] Aug. 16, 1977

[54] COMBUSTON METHOD OF OIL SHALE RETORTING

[76] Inventors: John B. Jones, Jr., 300 Enterprise Building, Grand Junction, Colo. 81501; Adam A. Reeves, P.O. Box 781, Anvil Points, Rifle, Colo. 81650

[21] Appl. No.: 677,556

[22] Filed: Apr. 16, 1976

[51] Int. Cl.[2] ..... C10G 1/02

[52] U.S. Cl. ..... 208/11 R; 201/16; 201/34

[58] Field of Search ..... 208/11 R; 201/8, 16, 201/34

[56] References Cited

U.S. PATENT DOCUMENTS

| | | | |
|---|---|---|---|
| 3,318,798 | 5/1967 | Kondis et al. | 208/11 R |
| 3,464,913 | 9/1969 | Berry | 208/11 R |
| 3,487,001 | 12/1969 | Needham | 208/11 R |
| 3,503,869 | 3/1970 | Haddad et al. | 208/11 R |
| 3,736,247 | 5/1973 | Jones et al. | 208/11 R |

*Primary Examiner*—Delbert E. Gantz
*Assistant Examiner*—James W. Hellwege

[57] ABSTRACT

A gravity flow, vertical bed of crushed oil shale having a two level injection of air and a three level injection of non-oxygenous gas and an internal combustion of at least residual carbon on the retorted shale. The injection of air and gas is carefully controlled in relation to the mass flow rate of the shale to control the temperature of pyrolysis zone, producing a maximum conversion of the organic content of the shale to a liquid shale oil. The parameters of the operation provides an economical and highly efficient shale oil production.

5 Claims, 3 Drawing Figures

COMBUSTON METHOD OF OIL SHALE RETORTING

This invention resulted from work done under Lease Agreement dated May 11, 1972, between the United States (represented by Honorable Rogers C.B. Morton, Secretary of the Interior) and Development Engineering, Incorporated.

Oil shale, i.e. a rock or mineral commonly called an oil shale, is found in many parts of the world, with substantial beds of the oil shale particularly in Colorado, Utah and Wyoming. Small size commercial operations for recovering oil from the oil shale have been carried out in many countries of the world, including the United States. However, currently there are apparently no large commercial plants in the United States. With the depletion of easy available petroleum, substantial amount of research has been done for the recovery of shale oil from the oil shale.

Shale oil is not a naturally occuring product in the oil shale, and to produce shale oil from the rock, it is subjected to a pyrolysis. The organic matter in the oil shale is converted to some permanent gas, some consensable gas, a liquid called shale oil, and a carbonaceous residue. In the rock, the organic material has limited solubility in ordinary solvents, but upon strong heating a shale oil is formed which resembles petroleum in some respects. Shale oil from various sources may be quite different in properties, and two of the major factors affecting the differences are the oil shale source and the method of processing the rock to produce the oil.

It is known that a temperature on the order of slightly over 900° F is necessary to effectively convert the organic material of the rock to oil. As the temperature of the pyrolysis increases considerable differences may occur in the resultant shale oil. For economic considerations, however, it would appear to be desirable to maintain the pyrolysis temperature as low as necessary to produce oil and to convert substantially all of the organic carboneous material to oil or gas. The lower temperature, also, reduces the carbonate degradation.

The pyrolysis of the organic material in oil shale, in its fundamental aspects, appears to be a relatively simple operation. The process involves heating the shale to a proper temperature and recovering the products which are emitted from the shale. In practical application, however, this apparently simple operation has not been achieved in a large shale commercial application even though dozens of types of processes and literally hundreds of types of equipment have been devised for the oil shale retorting process. In one general method, oil shale is mined, reduced to relatively small particles fed to a kiln where it is heated to a temperature necessary to produce the required pyrolysis. The pyrolysis, generally, produces a mist of liquid droplets and various gases which are withdrawn from the particulate shale. The retorted shale is subsequently discarded. One effective type of retorting vessel is a vertical shaft kiln, such as shown in the U.S. Pat. No. 3,736,247, patented May 29, 1973, U.S. Pat. No. 2,757,129 patented July 31, 1956, U.S. Pat. No. 2,901,402 patented Aug. 25, 1959, among many others.

From a practical consideration, an effective process has been achieved in a shaft kiln by a gravity flow, continuously moving shale bed in the kiln produced by feeding solids to the top and withdrawings solids from the bottom to maintain a uniform depth of the bed. The retort includes essentially three vertically aligned zones namely, a top preheating zone for the shale (which also provides for the disengagement of the products of the pyrolysis from the raw shale) a mid zone for pyrolysis and a cooling zone below the pyrolysis zone. This process utilizes incoming ambient temperature solids to cool the rising stream of the produced products from the pyrolysis, so that the products leave the bed at a relatively low temperature. For an economic heat balance, the shale leaving the pyrolysis zone is cooled by bottom injected incoming gas. This gas is heated and rises up through the particulate shale, through the retorting zone and is subsequently withdrawn as off-gas with the produced pyrolysis products.

Generally speaking two major processes have been used in the vertical or shaft kiln, the first being a direct combustion process in which residual carbon on the shale is burned in the kiln, producing the heat for the pyrolysis; and the second being an indirect heat retorting in which a non-oxygneous gas is heated externally of the retort and is introduced immediately below the retorting zone, with the incoming heated gas being of a sufficient temperature to produce pyrolysis.

The present invention involves a direct retorting method in which combustion in the kiln produces the heat necessary for the pyrolysis for the oil shale. In this process, a generally non-oxygenous gas (usually produced by the pyrolysis) is passed at a low temperature into the bottom of the shale bed so as to cool the hot retorted shale and simultaneously heat the gas as it passes up the column of the shale. A carefully controlled quantity of oxygen containing gas in then introduced into two mid-locations of the bed to provide a high rate oxidation process, termed combustion, in the kiln and to produce sufficient heat for retorting the oil shale. The resultant gases and shale oil mist pass from the pyrolysis upwardly through the incoming raw shale, and are disengaged from the shale and passed out to a shale oil recovery system. With properly controlled parameters, the operational efficiency of the process, on a extended production run, approaches a 100% recovery of shale oil and low BTU gas, based on the Fisher Assay (F.A) method of testing the oil shale. Such a method is, also, used for determining the physical qualities and/or quantities of shale oil and gaseous products of the pyrolysis as well as other compositions. In general, the shale is sized to a consist of between + ½ to 2 ¾ inches, the quantity of the injected air into the kiln is above about 5,000 standard cubic feet per ton (SCF/T) of shale and the amount of non-oxygenous gas is above about 15,000 SCF/T, producing some 20,000 to 25,000 SCF/T shale.

Including among the objects and advantages of the present invention is to provide an efficient commercial process for the retorting of oil shale to produce an oil, and provide a Fischer Assay recovery of the organic carbon material of the raw shale approaching 100%.

Another object to the invention is to provide a process for retorting oil shale in a vertical column with a preferential oxidation carbonaceous of carboneous residue on the shale to produce the heat necessary for the pyrolysis of the carbonaceous material in the oil shale.

Another object to the invention is to provide a process for the retorting of the carbonaceous material in oil shale under controlled conditions, including the temperature, to provide a very high Fischer Assay yield, and a low decomposition of mineral carbonates in the shale.

A still further object of the invention is to provide a retorting process of carbonaceous material in oil shale with a carefully controlled rate of introduction of oxygen containing gas into a bed of oil shale to produce only the necessary temperatures for pyrolysis, and to produce optimum pyrolysis of the carbonaceous material of the shale.

These and other objects and advantages of the present invention may be readily ascertained by referring to the following description and appended illustrations in which.

A kiln, according to a preferred form of the invention, is a vertical vessel, common to calcining or retorting arts, having a top feed for pulverulant oil shale and a bottom discharge, which is arranged to discharge solids from the kiln at a rate to maintain a moving, but essentially constant depth of bed in the kiln. Various gases are introduced into the kiln at various positions, with gas distributors provided between the ends of the kiln. Such a distributor as shown in U.S. Pat. No. 3,432,348, issued Mar. 11, 1969, may be used for providing a laterally uniform distribution of gas across the kiln. One means for withdrawing shale from the bottom of the kiln is commonly called a grate and a suitable grate is shown in U.S. Pat. No. 3,401,992 issued Sept. 17, 1968 entitled Linear Grate for Shaft Kilns. The grate and the gas distribution means provide an excellent system for the uniform flow of solids thru the kiln, particularly laterally across its crosssectional extent of the kiln, so that all solid particles are equally treated with the gases of the process. If the solid feed size consist is from ½ inch to 2 ½ inches, the void space in the bed is about 40%. With continuous movement of the bed, there is particle to particle contact re-adjustment, but the void space remains constant. However, new surfaces of the solid particles are exposed to the gas providing highly efficient heat transfer and reaction of gas with the solid surfaces. By maintaining a uniform flow of shale thru the kiln, combustion may be initiated in a particular zone and it may be maintained in that zone by careful control of the gases introduced into the kiln. The heat produced by the combustion is transferred into the upper raw shale for retorting, and the induced gas as well as produced gas along with the mist of oil is withdrawn from the kiln for processing. The processing includes the removal of the liquids, and processing some of the gas for its return to the kiln.

Figure 1:
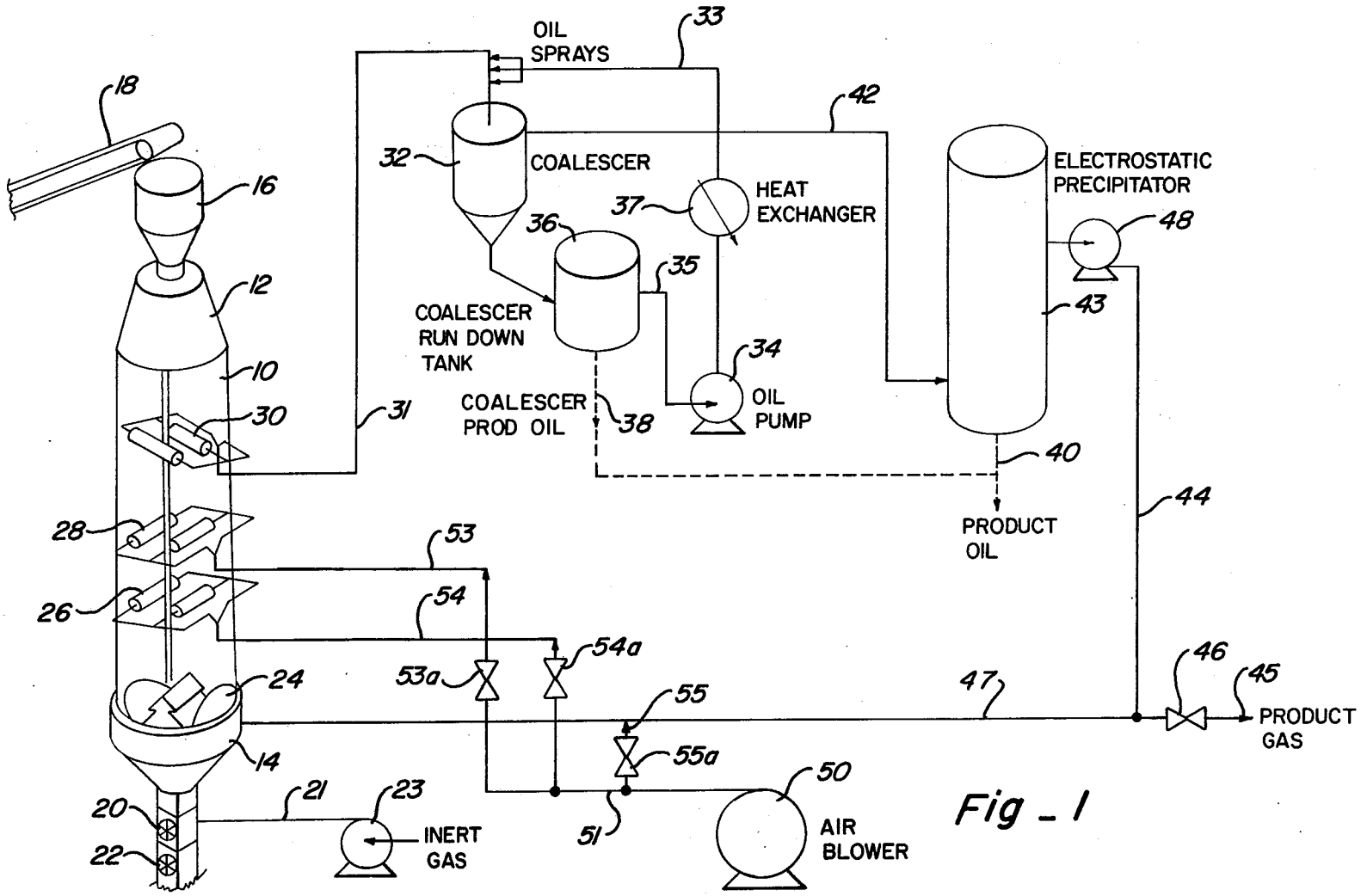
FIG. 1 is a plant lay-out of one form of the invention showing schematically the arrangement of the pyrolysis kiln and process equipment for produced products.

In the system shown in FIG. 1, a vertical kiln 10, shown in phantom, and generally it consists of a metal skin with a refractory lining as is common in the art. The kiln is provided with a top feed 12 and a bottom withdrawal 14 secured to the ends of the vertical cylindrical member. A feed hopper 16, fed by a belt conveyor 18, provides a gravity flow of crushed shale into the kiln. A pair of star feeders 20 and 22 mounted on the outlet of the lower end 14 provides means for withdrawing retorted shale from the kiln. A grate mechanism, not shown, is mounted in the lower end 14, below a gas inlet means 24, which includes side and middle distributor means for injecting gas into the bottom of the column of shale in the kiln. A first set of gas distributors 26 is mounted in the kiln substantially above the bottom distributor 24 and a second set of distributors 28 is mounted thereabove. An off-gas collection system 30 is provided above the upper distributor system 28 and provides means for withdrawing gases and mist from the retorting.

In one highly effective size which has been used for a substantial periods of time, a nominal 10 foot diameter kiln with an overall height of about 50 ½ feet is provided with a bed of shale with a height of approximately 26 ½ feet from the lowest point of the bed to the feed inlet. The kiln is lined with refractory giving an effective inside diameter of about 8 ½ feet. The lower gas inlet is just above the grate, and the next or mid gas distributor is about 12 feet above the lowest part of the bed. The upper distributor is about 6 feet above the middle distributor. As pointed out, the gas and mist formed by the retorting and recycle gas may be either be withdrawn through an in-the-shale offgas distributors or through a port in the top of the kiln after the disengagement of the gas and mist from the top of the shale bed. In either case, the depth of the bed above the top distributor is closely controlled to provide heating of the incoming raw shale and the cooling of the products prior to their withdrawal from the top of the kiln. However, the products can not be cooled at a temperature gradient such that there is condensation and coalessing on the cooler shale. Such action causes refluxing, bridging, coking, blockages etc. A stable mist is formed by the proper rate of cooling and heat transfer. A high velocity of gas may carry out shale dust or may cause mist impaction against the shale, and the velocity thus has an upper limit. For example, at 700 pounds of shale per square foot per hour, with a superficial velocity of 3.2 feet per second of gas at the top of the bed, an increase in shale sediment was noticed. This might indicate the requirement for more efficient screening of the raw shale or a dusting and carry-over.

Raw shale is introduced into the kiln through lock means which prevents the escape of the gaseous products and mist by known devices, for example, star feeders, and the shale is withdrawn from the unit using the star feeders rotary feeders or the like, for preventing the release of gas from the kiln during feeding. Inert gas may be inserted through line 21 to pressurize the star feeders to further prevent the loss of gas. The inert gas is controlled by a blower 23.

The gas and oil mist produced by the retorting is withdrawn from the bed through off-gas collector system 30 through a line 31 into a coalescer 32. Recovered oil from the coalescer is passed through line 33 into the line entering the coalescer 32 from a pump 34 which is fed from a line 35 from the coalescer run down tank 36. A heat exchanger 37 provides means for controlling the temperature of the oil sprayed into the line entering the coalescer. Product oil from the run down tank passes line 38 where it is combined with the product oil in line 40. The coalescer removes a substantial portion of the oil from the gas mist combination by intimate contact of the spray with the larger droplets and the gas from the coalescer, containing a smaller amount of mist in smaller droplets, passes through a line 42 into an electrostatic precipitator 43 where the remaining liquid is removed from the gas. The generally liquid free gas passes through line 44 to a recycle gas blower 48 and then to a gas production line 45 controlled by a valve 46. A portion of the gas in line 44 passes through a line 47 into the bottom of the kiln as recycled gas. Air is introduced into the two internal distributor systems in the kiln from the blower 50 through line 51 which serves as a manifold to lines 53 connected to the upper distributors 28 and line 54 connected to lower distributors 26 respectively controlled by valves **53*a* and 54*a*. The line 47 in a like manner is fed with air by means of a line 55 controlled by a valve 55*a***. The distributors are mounted laterally in the kiln and are tubular members fed from both ends. Gas is released from the distributors through a series of orifices along each side of the tubular members. The size and/or spacing of the orifices are arranged to inject a predetermined quantity of gas into the lateral area serviced by the particular orifice. This provides a means for uniformly treating all shale particles passing through the kiln. The shale feed and withdrawal method provides a uniform flow of the particles down through the bed particularly across the lateral extent of the kiln.

The water introduced with the raw shale, and a lesser amount produced by the combustion internally of the vessel is carried out of the retort in the vapor state. The minimum off-gas temperature is then determined by the partial pressure of the water. For example, if the water vapor content is about 30% and the retort top pressure is 24.0 psia, the partial pressure of water vapor is 7.2 psia. This corresponds to a temperature of 150° F, and it is obvious that the off-gas temperature could be no lower than the water saturation temperature of the gas. Higher temperatures may be found with the direct mode of retorting oil shale, due to excess heat (like superheated steam) determined by the overall heat balance. The preferred temperature range of the off-gas is about 120° F to 200° F for the preferred operating parameters.

During an extended run using shale which had an average assay of 27.4 gallons per ton, it was crushed to size consisting of from about a nominal ⅜ inch to 2 ½ inches of the following screen analysis:

SCREEN ANALYSIS

| Size - Inches | Amount - Wt% |
|---|---|
| 3.00 | 0 |
| 2.50 | 2.3 |
| 2.00 | 14.7 |
| 1.50 | 39.6 |
| 1.050 | 21.0 |
| 0.742 | 11.9 |
| 0.525 | 7.5 |
| 0.371 | 1.0 |
| 0.263 | 0.9 |
| 0.185 | 0.3 |
| 0.093 | 0.6 |
| Pan | 0.6 |
| Loss | −1.4 |

For the extended run, shale (of the general size as defined above) was feed through a kiln at mass rate of about 450–500 pounds per hour per square foot of cross-section of the kiln. The shale bed in the kiln had a height of about 25 feet 6 inches. Bottom gas for cooling was introduced into the kiln at a rate of about 12,100 standard cubic feet per ton (S.C.F./T) at about 240° F. About 4,600 SCF/T of air was feed into the kiln for the combustion, with about 3,810 into the top distributor and about 850 SCF/T into the middle distributor. For dilution purposes, 13,000 SCF/T or recycle gas is introduced into the top distributor and about the same amount into the middle distributor. The produced products were withdrawn from the top of the kiln, in the off-gas collection system, at about 145° F., while the retorted shale was withdrawn from the kiln from about 380° F. The following table shows the average of the operating variables, by showing the means of 13 twenty four hour periods, along with the standard deviation of the separate periods during the total period conditions.

TABLE I

DEVIATION OF OPERATING VARIABLES AND YIELDS FOR A 10 FOOT DIAMETER KILN

| ITEM | MEAN | STANDARD DEVIATION OF TEST PERIOD COND. |
|---|---|---|
| Raw Shale Rate TPH | 11.2 | 0.27 |
| Raw Shale F.A. GPT | 27.2 | 0.52 |
| Oil Yield (DRY) GPH | 296.9 | 9.67 |
| Oil Water Content Wt% | 4.8 | 2.58 |
| Oil Yield Vol. % F.A. | 97.0 | 4.48 |
| Oil Yield Wt% F.A. | 97.5 | 4.53 |
| Gas Product Yield SCFM | 1396. | 27.54 |
| Air to Top Dist. SCFM | 709. | 7.95 |
| Air to Mid Dist. SCFM | 158. | 1.96 |
| Gas to Top Dist. SCFM | 254. | 3.09 |
| Gas to Mid Dist. SCFM | 245. | 3.72 |
| Gas to Bottom Dist. SCFM | 2255. | 23.37 |

Figure 2:
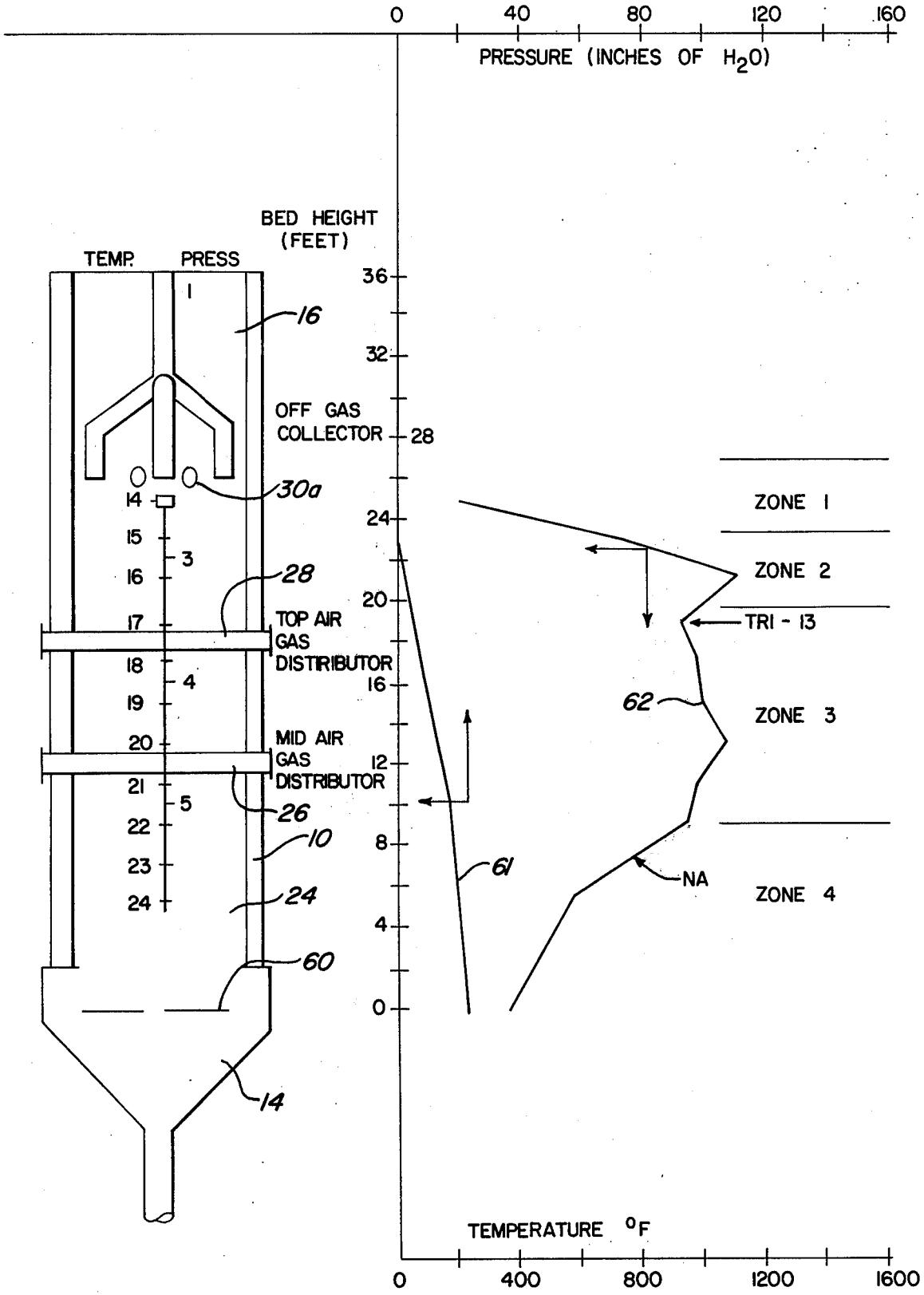
FIG. 2 is a schematic showing of a retort according to the invention illustrating a temperature profile of pyrolysis of oil shale according to the invention in the kiln.
Figure 3:
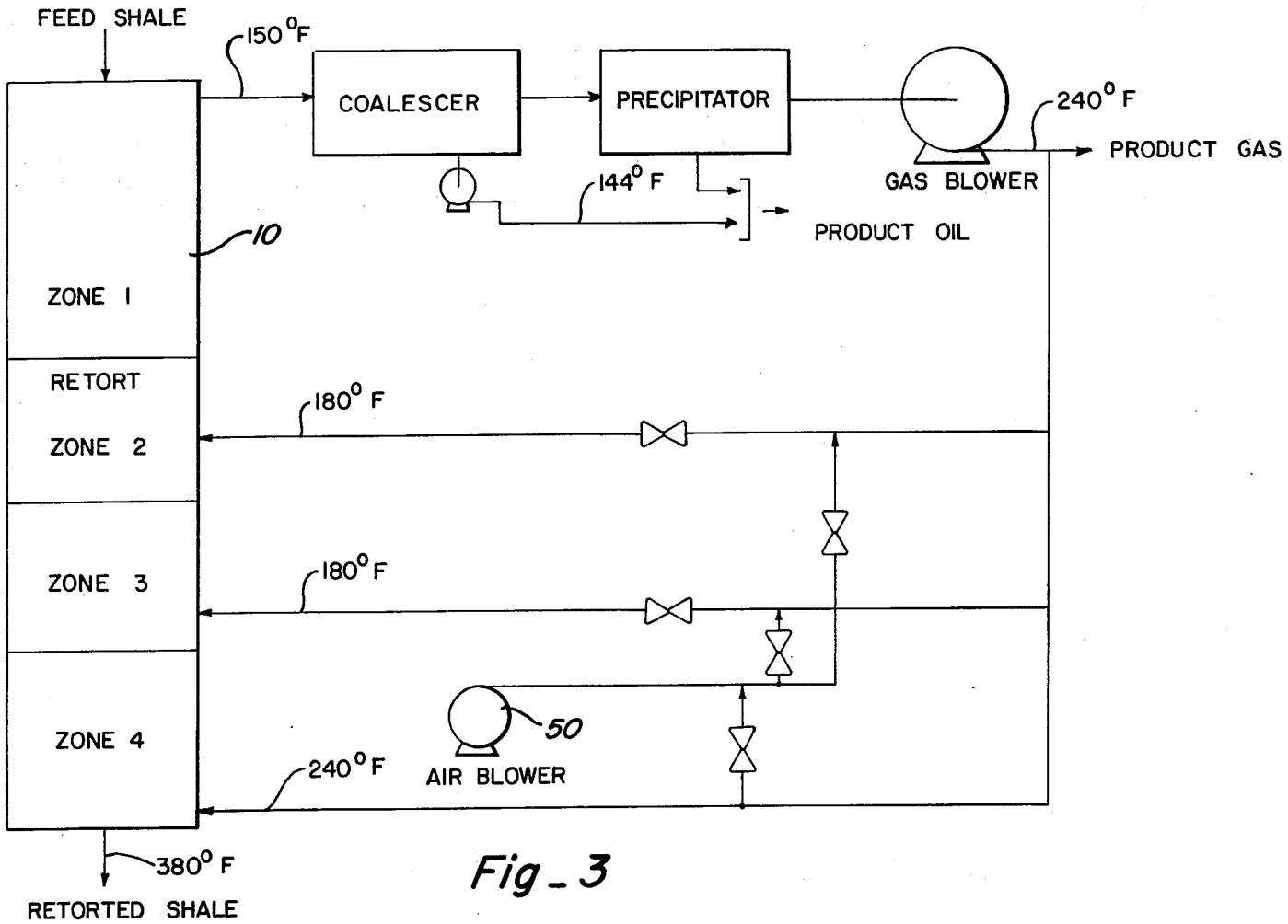
FIG. 3 is a schematic block diagram of a system according to the invention.

FIG. 2 demonstrates the run in an average temperature profile as related to the height of the bed in the kiln. In the schematic of the kiln, the bottom of the bed of shale is deliniated by means of a retarder plate 60 identified as elevation "zero" on the schematic. Cooling gas is introduced into the bottom distributor 24 which is immediately above the retarder plate 60. Air in accordance with the Table 1 above is injected into the middle distributor system 26 and the upper distributor system 28 in the specified amounts. A combustion occurs in the kiln providing heat for the retorting of the oil shale. The temperature profile, related to the height of the bed, is shown in the right hand side of schematic FIG. 2. The pressure drop through the kiln is shown in line 61, while the temperature is shown in the line 62, showing the maximum temperature of about 1100° F. immediately above both of the distributors. As shown in the chart of FIG. 2, zone 1 provides the heating zone for raw shale being introduced into the kiln (which simultaneously cools the produced gas and mist from the pyrolysis from the oil shale). Zone 2 provides a retorting zone immediately above a combustion zone. Zone 3 provides another combustion zone. Zone 4 provides the cooling zone for shale and the simultaneous heating zone for cooling gas upwardly through the shale. In Table II, below, there is shown a typical analysis of the raw shale, the product oil, the product gas, the retorted shale and the gas analysis.

TABLE II

| | |
|---|---|
| RAW SHALE PROPERTIES | |
| Moisture Content Wt% | 0.94 |
| Fischer Assay Gal/Ton | 27.2 |
| F.A. Wt% Oil | 10.39 |
| F.A. Wt% Water | 1.66 |
| F.A. Wt% Gas + Loss | 2.29 |
| Mineral $CO_2$ Wt% | 17.71 |
| Ignition Loss Wt% | 33.07 |
| Carbon Wt% | 17.05 |
| Hydrogen Wt% | 1.84 |
| Nitrogen Wt% | 0.52 |
| Nominal Part. Size In. | 2 ¾ × ⅜ |
| PRODUCT OIL PROPERTIES | |
| Gravity, Deg. API | 21.3 |
| Viscosity SUS 130° | 90.7 |
| Viscosity SUS 210° | 42.2 |
| Ramsbottom Carbon Wt% | 1.54 |
| Water Content Vol% | 2.37 (2.56 wt%) |
| Solids, BS, Wt% | 0.14 |
| Carbon Wt% | 84.53 |
| Hydrogen Wt% | 11.51 |

TABLE II-continued

| | |
|---|---|
| Nitrogen Wt% | 1.92 |
| Sulfur Wt% | .56 |
| PRODUCT GAS PROPERTIES (DRY BASIS) | |
| Gross Heat. Value BTU/SCF | 100 |
| Specific Gravity | 0.999 |
| Oil Content, Gal/Mcf | 0.093 |
| RETORTED SHALE PROPERTIES | |
| Fischer Assay Gal/Ton | 0.17 |
| Mineral $CO_2$ Wt% | 15.78 |
| Organic Carbon Wt% | 1.85 |
| F.A. Wt% Oil | 0.06 |
| F.A. Wt% Water | 0.16 |
| F.A. Wt% Gas + Loss | 0.38 |
| Ignition Loss Wt% | 17.35 |
| Carbon Wt% | 6.15 |
| Hydrogen Wt% | 0.16 |
| Nitrogen Wt% | 0.2 |

The following Tables III, IV and V show the composite results of a twenty-six day run of the kiln, described above, setting forth the general parameters of the operation of the kiln and the yield of oil, gas, water, etc.

TABLE III

| | |
|---|---|
| Length of Run | 26 Days |
| Mass Rate #/Hr./Ft.$^2$ | 455 |
| Bottom Gas (Cooling) Rate SCF/T | 12,100 at 240° F |
| Top Air SCF/T | 3810 |
| Top Gas SCF/T | 1300 |
| Middle Air SCF/T | 850 |
| Middle Gas SCF/T | 1310 |
| Off-Gas Temperature | 145° F |
| Retorted Shale Temperature | 384° F |
| % F.A. Yield | |
| Liquid as recovered in tank | 92 |
| $C_5$+ in product gas (not taken into account in gas quality) | 5 |
| Total by Vol. | 97 |

TABLE IV

| Oil Quality | |
|---|---|
| API | 21.4° |
| VIS: 130° | 89.9 SUS |
| 210° | 46.5 SUS |
| R.B.C. | 1.73% Wt. |
| $H_2O$ | 4.46% Vol |
| Solids | 0.47% Wt. |
| C | 84.62% Wt. |
| H | 11.50 |
| N | 2.0 |

TABLE V

| Gas Quality | 7500 S.C.F/T (wet) |
|---|---|
| $H_2$ | 3.07 Vol% |
| $N_2$ | 54.30 Vol% |
| $O_2$ | —0— |
| CO | 2.08 Vol% |
| $CH_4$ | 1.82 Vol% |
| $CO_2$ | 20.03 Vol% |
| $C_2H_4$ | 0.55 Vol% |
| $C_2H_6$ | 0.51 Vol% |
| $C_3$ | 0.59 Vol% |
| $C_4$ | 0.30 Vol% |
| $H_2O$ | 17.33 Vol% |
| $H_2S$ | 2200 ppm |
| $NH_3$ | 2060 ppm |
| Heating Value | 100 BTu/cu.ft. (dry basis) |

While the total bed height is not critical to the operation, it of course is essentially critical for the overall economics of the construction, i.e. a higher bed increases the cost of the kiln and the power required to overcome gas pressure differential. A certain height is, however, necessary to separate the two points of air entry at about 6 feet. Also, about 12 feet has been found satisfactory to provide (a) cooling of the retorted shale and (b) heating of recycle gas. Most important is the depth of bed above the retorting zone. This depth must be sufficient to cool the products of pyrolysis to only about 150° F. and to preheat the raw shale. A height of about 7 feet above the top distributor for air/gas inlet is effective since any greater depth cause condensation or coalescing of the mist producing refluxing and cracking of the oil. This leads to coke production, conglomerating the shale, and/or bridging of the shale in the upper portion of the shale bed.

In addition to the above physical dimensions, there are important gas to feed relationships. If the bottom gas is less than about 10,000SCF/T, retorted shale is discharged at higher temperature with a loss of thermal efficiency. At a very high ratio above 16,000 SCF/T, the retorted shale temperature is lower but the retort temperatures are too low to sustain combustion and to effect pyrolysis.

When mixtures of gas and air are distributed to establish combustion zones, the gas percentage of those mixtures should be outside the flammable limits so that residual carbon will burn in preference to shale gas—an important co-product of retorting. For a gas of the composition shown in Table V, the lower limit is about 34% gas and the upper limit is about 47% gas in a gas and air mixture. The top distributor mixture is 25% gas and thus is too lean to burn. The middle distributor mixture is 61% and too rich to burn.

The vertical distribution of air is another important consideration. From 67 to 85% of the total air input should be injected at the top distributor to insure that the retorting zone is maintained well above the top distributor. Otherwise, incompletely retorted shale could contact oxygen at either the top or middle distributor with a potential loss of oil yield. The smaller portion of air (15% to 33%) should be injected at the middle distributor. With a longer oxygen residence time above about 950° F, carbon will burn preferentially to carbon monoxide to produce additional heating value gas from a portion of the carbon residue which would otherwise be discarded with the retorted shale. Another factor in preferential carbon combustion is that the injected mixture is gas rich and becomes more rich after mixing in the bed with recycle gas. The general effect is to distribute the combustion through a large volume of solids so that the maximum temperature is limited and the heat absorption reaction of carbonate decomposition is lower. Less air is required, less mineral carbon dioxide is produced, and the unit heating value of the product gas increases.

The gas to shale relationship in the top portion of the retort is of primary importance. In this zone, the shale is dried and preheated to pyrolysis temperature. The hot gas leaving the top of the pyrolysis zone contains oil vapor which must be condensed into a stable oil mist and swept from the retort minimum loss by impingement on the bed of shale as a liquid film or by oil vapor condensation on the shale. Either of these effects results in the transport of liquid oil down to the pyrolysis zone where it is subjected to thermal cracking. This phenomenon has been called "refluxing" and is undesirable in that liquid oil yield is lost by the production of gas and carbonaceous residue. Also undesirable is the agglomeration of the bed of shale particles by the carbonaceous residue which is quite sticky just before being converted to a dry coke.

Operating experience has determined that the volume of gas leaving the top of the retort should be between 20,000 and 24,000 standard cubic feet per ton of shale feed to minimize the refluxing condition. From Tables III and V, the pertinent quantities are:

| | |
|---|---|
| Top Gas | 1,300 Std. C.F./T |
| Middle Gas | 1,310 Std. C.F./T |
| Bottom Gas | 12,100 Std. C.F./T |
| Product Gas | 7,500 Std. C.F./T |
| Total Off-Gas | 22,210 Std. C.F./T |

The product gas was 1.61 times the air input. Using $A_T$, $A_M$, $G_T$, $G_M$, $G_B$ for Top Air, Middle Air, Top Gas, Middle Gas, Bottom Gas respectively, off-gas, SCF/T can be expressed as:

$$1.61\,(A_T + A_M) + G_T + G_M + G_B = \text{off-gas,SCF/T}.$$

Thus, there is some latitude in the selection of the recycle gas ratios ($G_T$, $G_M$, $G_b$), but the restraints of bottom gas ratio and air-gas mixtures discussed previously must be taken into account while maintaining the off-gas ratio in the desired range of 20,000 to 24,000 SCF/T.

What is claimed is:

1. A process for retorting oil shale in a direct combustion heating mode in a vertical vessel for producing shale oil and gas above 95% liquid recovery efficiency based on a Fischer Assay comprising:

a. forming a bed of shale under a gravity flow in a closed, vertical kiln in a mass flow rate of 450–500 pounds per square foot per hour in a continuous flow, said raw shale being in a particulate size range consist of + ⅜ inch to −3 inch;

b. feeding particulate raw shale at ambient temperatures onto the top of the shale bed at said mass flow rate and withdrawing sufficient retorted shale from the bottom of the bed so as to maintain a bed of about 26′ in depth, said retorted shale being withdrawn at a temperature of about 300°–400° F.;

c. injecting air heated to about 180°–200° F. into said bed at a rate of about 4,000 to 4,800 standard cubic feet per shale ton, said air being introduced at two positions across the lateral extent of said bed, the first said position being at about 6–7 feet below the top surface of the bed, and the second position being at about 12–13 feet below the surface of the bed and the two positions being in a ratio of about 2–1 to 5–1 volumes of air respectively of said first to said second positions;

d. injecting an essentially inert gas at a temperature of about 150°–240° F. into said bed at a rate of 13,000 to 16,000 standard cubic feet per shale tone, said gas being injected into said first position being mixed with air therein, into said second position being mixed with air therein and through the bottom of said bed as a third position for passing upwardly through the shale bed, and the ratio being about 1 to 1 to 8 volumes respectively;

e. the heat for the retorting of the shale being provided by combustion at temperatures of from 900°–1100° F. in a zone about 1–3 feet above the first position and about 900°–1050° F. about 1–2 feet above the second position; and f. withdrawing a mixture of gas and shale oil mist from an upper part of the bed for recovery of liquid and gas therefrom.

2. A process according to claim 1 wherein the raw shale has an kerogen content of 15–35 gallons per ton of shale based on a Fischer Assay.

3. A process according to claim 1 wherein the size consist of the shale is + ½ inch to −2 ¾ inch with all shale below about ½ inch in average size being screened out of the consist.

4. A process according to claim 1 wherein 4,600 standard cubic feet per shale ton of air is injected into said two positions, and about 14,500 standard cubic feet per shale ton of inert gas is injected into said shale bed.

5. A method of retorting oil shale in a closed vertical vessel under direct combustion conditions providing an overall efficiency of about a 97% F.A. organic carbon recovery comprising:

a. forming a bed of crushed oil shale in a ⅜ inch ⁶½ inch size consist and about 26′ deep;

b. feeding crushed shale at ambient temperatures to the top of the bed and removing retorted shale from the bottom to maintain a continuous gravity flow of the shale, at about 450–500 pounds per hour per square foot of kiln cross section;

c. injecting air of about 3,810 standard cubic feet per shale ton through a top distribution means at a temperature of about 200°–250° F. into said bed across its lateral extent at about 7′ below the top surface of the shale, further injecting air of and about 850 standard cubic feet per shale ton through a lower distribution means at about 200°–250° F. into said bed about 7 feet below said first air injection;

d. injecting inert, generally non-oxygenous gas at a temperature of about 240° F. into said bed at a rate of about 14,660 standard cubic feet per shale ton with about 9% of the gas injected with air through the top distribution means about 9% of the gas with air into the lower distribution means and about 82% of the gas into the bottom of the bed, and e. withdrawing a mixture of gas and shale oil mist from the top of the bed at about 145° F. and withdrawing retorted shale from the bed at about 350° F.

* * * * *